United States Patent [19]

Steddum et al.

[11] 4,260,292

[45] Apr. 7, 1981

[54] ARCTIC OFFSHORE PLATFORM

[75] Inventors: Riddle E. Steddum; Theodore H. Nezames; Terrence M. Smith; Bruce L. Crager, all of Houston, Tex.

[73] Assignee: The Offshore Company, Houston, Tex.

[21] Appl. No.: 88,323

[22] Filed: Oct. 25, 1979

[51] Int. Cl.[3] ..... E02D 21/00

[52] U.S. Cl. ..... 405/217; 405/61; 405/211

[58] Field of Search ..... 405/195–208, 405/211–217, 224–227, 61; 114/40, 43, 264–267; 9/8 R; 126/343.5 R, 343.5 A; 175/5–9; 62/355; 43/4, 4.5

[56] References Cited

U.S. PATENT DOCUMENTS

| | | | |
|---|---|---|---|
| 2,699,042 | 1/1955 | Hayward | 405/207 |
| 3,170,299 | 2/1965 | Clarke | 405/61 |
| 3,193,260 | 7/1965 | Lamb | 9/8 R |
| 3,271,963 | 9/1966 | Blenkarn | 405/211 |
| 3,370,432 | 2/1968 | Butler et al. | 405/216 |
| 3,448,585 | 6/1969 | Vogelsang | 405/216 |
| 3,669,052 | 6/1972 | Schirtzinger | 405/217 |
| 3,693,360 | 9/1972 | Holder | 405/211 |
| 3,702,542 | 11/1972 | Hemstock | 405/211 |
| 3,740,956 | 6/1973 | Guy et al. | 405/205 |
| 3,749,162 | 7/1973 | Anders | 405/217 X |
| 3,759,046 | 9/1973 | Anders | 405/211 |
| 3,766,874 | 10/1973 | Helm et al. | 405/217 |
| 3,768,264 | 10/1973 | Best | 405/61 |
| 3,807,179 | 4/1974 | Stone | 405/61 |
| 3,831,385 | 8/1974 | Hudson et al. | 405/211 |
| 3,842,607 | 10/1974 | Kelseaux et al. | 405/217 |
| 3,844,126 | 10/1974 | Blurton et al. | 405/217 |
| 3,872,814 | 3/1975 | Rodriguez . | |
| 3,894,504 | 7/1975 | Smith | 405/211 |
| 3,952,527 | 4/1976 | Vinieratos et al. | 405/217 |
| 3,972,199 | 8/1976 | Hudson et al. | 405/217 |
| 4,029,035 | 6/1977 | German . | |
| 4,048,943 | 9/1977 | Gerwick | 405/211 |
| 4,055,052 | 10/1977 | Metge | 405/217 |
| 4,075,964 | 2/1978 | Sjogren | 114/40 |
| 4,080,796 | 3/1978 | Edling et al. | 405/226 |
| 4,080,797 | 3/1978 | Thompson | 405/217 |
| 4,080,798 | 3/1978 | Reusswig et al. | 405/207 |
| 4,094,149 | 6/1978 | Thompson et al. . | |
| 4,102,144 | 7/1978 | Anders . | |
| 4,117,794 | 10/1978 | Sjogren | 114/40 |

FOREIGN PATENT DOCUMENTS

| | | | |
|---|---|---|---|
| 981035 | 1/1976 | Canada | 405/217 |

*Primary Examiner*—Dennis L. Taylor
*Attorney, Agent, or Firm*—Bradford E. Kile

[57] ABSTRACT

The invention relates to an offshore platform operable for use in Arctic locations where prolonged ice conditions may be encountered. The platform includes a lower barge hull having an exterior configuration in the general shape of a rectangular frustum and being operable to be fixed relative to a desired seabed site. The lateral side walls of the barge hull are heated for facilitating movement of contiguous sea ice upwardly relative to the barge side walls to fail the ice in bending as it advances toward the barge hull. A deck is positioned above the lower barge hull and is supported by a first and second column at an elevation whereby the lower surface of the deck will be above and out of contact with sea ice passing over the hull. The deck is positioned relative to the barge hull in a posture such that at least a portion of the deck extends beyond an imaginary vertical plane projecting upwardly from at least one longitudinal edge of the upper surface of the barge hull.

14 Claims, 6 Drawing Figures

FIG. 1
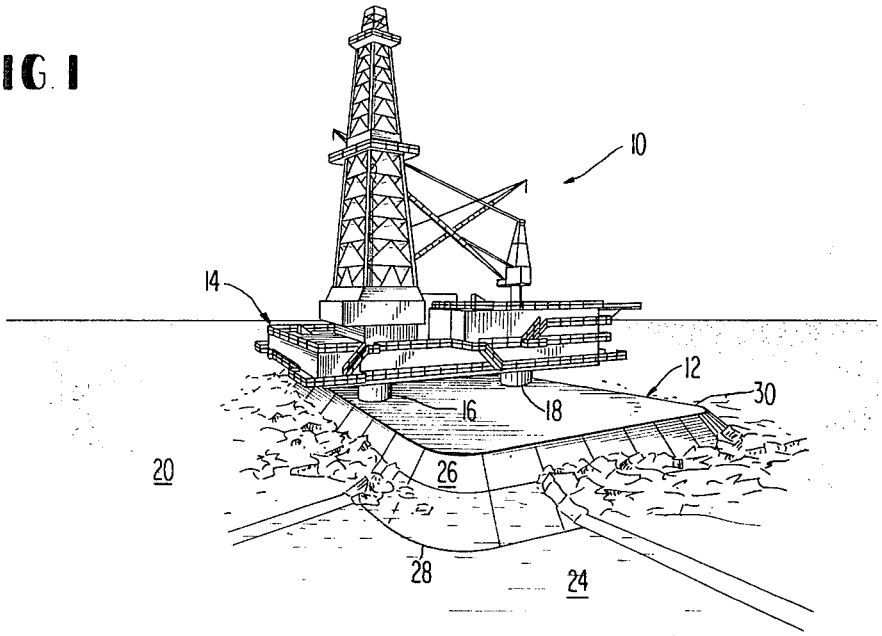
FIG. 2
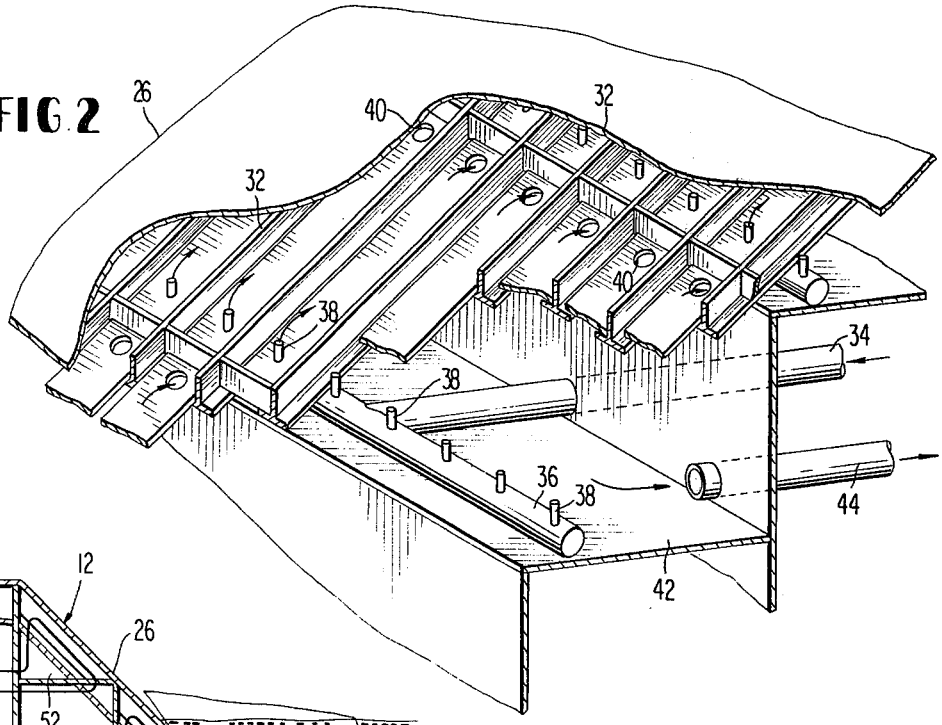
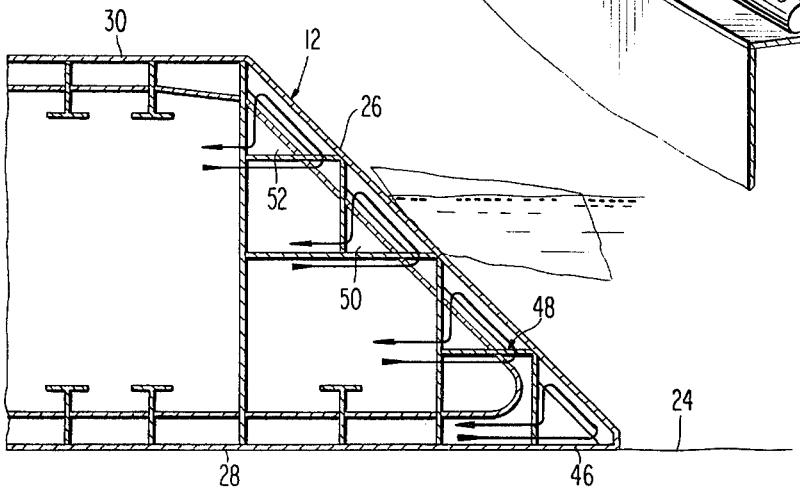
FIG. 3

ARCTIC OFFSHORE PLATFORM

BACKGROUND OF THE INVENTION

This invention relates to a novel offshore platform operable for use in the Arctic. More specifically, the invention relates to an offshore platform which may be used in Arctic locations where prolonged ice conditions may be encountered.

In the past, offshore platforms or towers have been extensively utilized around and upon the continental shelf regions of the world. Examples of offshore platform installations include supports for radar stations, light beacons, scientific and exploration laboratories, chemical plants, power generating plants, etc. Principally, however, offshore platforms have been used by the oil and gas industry in connection with oil and gas drilling, production and/or distribution operations.

In the initial stages of offshore drilling/production activity, operations were conducted along the near shore portions of the Gulf of Mexico in swamp or marshlands and seaward to water depths of 100 or more feet. In an attempt to keep pace with a burgeoning worldwide energy demand, more recent offshore activity has been decidedly more aggressive and has been directed to deeper water locations ranging up to 1,000 or more feet in depth and in areas of adverse environmental loading such as the unpredictable aerodynamics and hydrodynamic forces of the North Sea. Additionally, recent attention has become directed to the extremely adverse environment of the Arctic. In this connection offshore platforms operating in Arctic regions must be capable of working for prolonged periods on station while accommodating ice floes which would facilely topple and/or crush conventional open water platform designs.

In an attempt to cope with the Arctic frontier, numerous platform designs have been at least theorized by the offshore industry. Many arctic designs attempt to prevent massive ice floes from directly loading an offshore platform. More specifically, such designs rely primarily upon mechanical elements to break up advancing sea ice and/or melt the ice at a rate greater than the rate of advancement of the ice toward the stationary platform. Although such prior designs may provide a degree of theoretical appeal, the size and strength requirements of mechanical units and the heat energy required to implement ice melting concepts has tended to chill optimism for practical implementation of most previously known designs.

A significant advance was disclosed to the industry by the issuance of a United States Reusswig et al. U.S. Pat. No. 4,080,798 entitled "Arctic Drilling Base", of common assignment with the instant application. In this connection the Reusswig et al. patent discloses a drilling and/or production base wherein the lateral skin of the base is heated sufficiently to maintain a film of water between its sloping side wall surfaces and an advancing sheet of sea ice. This water film facilitates sliding action of the ice upwardly against the inclined side walls of the base to fail the oncoming ice in bending, rather than in compression.

Notwithstanding the advantages provided by the foregoing Reusswig et al. design, room for improvement remains. In this regard it would be highly desirable to provide an offshore platform for work in Arctic regions which would retain the advantages of preventing ice adhesion to a hull and failing the ice in bending while enhancing the capability of the platform to perform year round offshore operations. Additionally, it would be desirable to provide an offshore platform for work in the adverse conditions of the Arctic which would be structurally rugged while minimizing the weight of the platform. Further, it would be advantageous to provide an arctic offshore platform which would have a minimum draft to facilitate placement of the platform along near shore portions of the Arctic seas. Still further it would be desirable to provide an Arctic offshore platform wherein environmental hydrodynamic and ice forces may be effectively isolated from operational equipment mounted upon the platform. Yet further it would be advantageous to provide an Arctic offshore platform wherein supply and emergency abandonment of the platform may be enhanced.

The difficulties suggested in the preceding with regard to prior Arctic offshore platforms are not intended to be exhaustive, but rather are among many which may tend to limit the effectiveness and satisfaction with prior platform systems. Other noteworthy problems may also exist; however, those presented above should be sufficient to demonstrate that prior Arctic offshore platforms will admit to worthwhile improvement.

OBJECTS OF THE INVENTION

It is therefore a general object of the invention to provide a novel offshore platform which will obviate or minimize difficulties, while concomitantly achieving desired advantages, of the type previously described.

It is a specific object of the invention to provide a novel offshore platform which will minimize the possibility of environmental sea forces impacting against working equipment mounted upon the platform.

It is a related object of the invention to provide a novel offshore platform for operation in Arctic regions where storm waves and ice floes will be induced to ride over a hull portion of the platform while an operational deck is maintained in an relative isolated posture above such adverse environmental loading.

It is another object of the invention to provide a novel offshore platform wherein the platform steel weight may be minimized.

It is yet another object of the invention to provide a novel offshore platform wherein the draft of the platform is minimized.

It is still another object of the invention to provide a novel offshore platform wherein emergency abandonment of the platform is facilitated in an adverse Arctic environment.

It is a further object of the invention to provide a novel offshore platform wherein a large variable storage capability is provided to facilitate year round operations in an ice locked Arctic environment.

It is yet a further object of the invention to provide a novel offshore platform which will facilitate resistance of the platform to lateral environmental forces imposed by the contiguous sea.

It is a related object of the invention to provide a novel offshore platform which will incorporate the advantageous capabilities of preventing ice from freezing to the platform hull and failing the ice in bending while simultaneously isolating operational equipment from the forces of the environment.

It is another object of the invention to provide a novel offshore platform which will minimize substructure size and maximize the seabed contact area of the platform.

It is still a further object of the invention to provide a novel offshore platform which will facilitate fabrication and minimizes construction expense.

BRIEF SUMMARY OF A PREFERRED EMBODIMENT OF THE INVENTION

A preferred embodiment of the invention which is intended to accomplish at least some of the foregoing objects comprises a lower barge hull operable to be fixedly positioned with respect to an Arctic seabed station. The barge hull has an exterior configuration in the general shape of a rectangular frustum with upwardly and inwardly sloping lateral side walls extending from a position at least below the lowermost anticipated ice level to a position above the sea ice surface of the contiguous Arctic waters. The barge hull has a central longitudinal axis extending end to end and a central transverse axis extending side to side of the hull. A heating system is provided within the barge to heat at least the lateral side wall portions of the hull for facilitating movement of sea ice up the inclined side walls to fail the sea ice in bending as it advances toward the offshore platform.

A generally rectangular deck is positioned above the lower barge hull and has a central longitudinal axis extending end to end and a central transverse axis extending side to side of the deck. The deck is maintained at an elevated posture with respect to the barge hull by a first and second column extending between an upper surface of the hull and a lower surface of the deck. The deck is positioned above the barge hull such that the longitudinal axis of the deck extends at right angles to the longitudinal axis of the hull and at least one end of the deck extends beyond an imaginary vertical plane projecting upwardly from at least one longitudinal edge of the upper surface of the barge hull.

With the foregoing described hull, post and deck construction, arctic environmental loading such as storm waves and ice floes will flow up the sides of the barge hull and over the upper surface of the barge without impinging upon the platform deck. The particular transverse orientation of the deck with respect to the hull permits forces impinging upon a maximum beam surface of the platform deck to be reacted by the major moment arm of the underlying barge hull. Moreover, in instances of emergency evacuation the deck orientation permits crewmen to be lowered from the platform deck directly onto an underlying ice formation.

THE DRAWINGS

Other objects and advantages of the present invention will become apparent from the following detailed description of a preferred embodiment thereof taken in conjunction with the accompanying drawings, wherein:

FIG. 1 is an axonometric view of an offshore platform in accordance with a preferred embodiment of the invention;

FIG. 2 is a partial axonometric view of a forced convection heating system mounted within the offshore platform hull;

FIG. 3 is a cross-sectional schematic view of the forced convection heating system depicted in FIG. 2;

DETAILED DESCRIPTION

Figure 4:
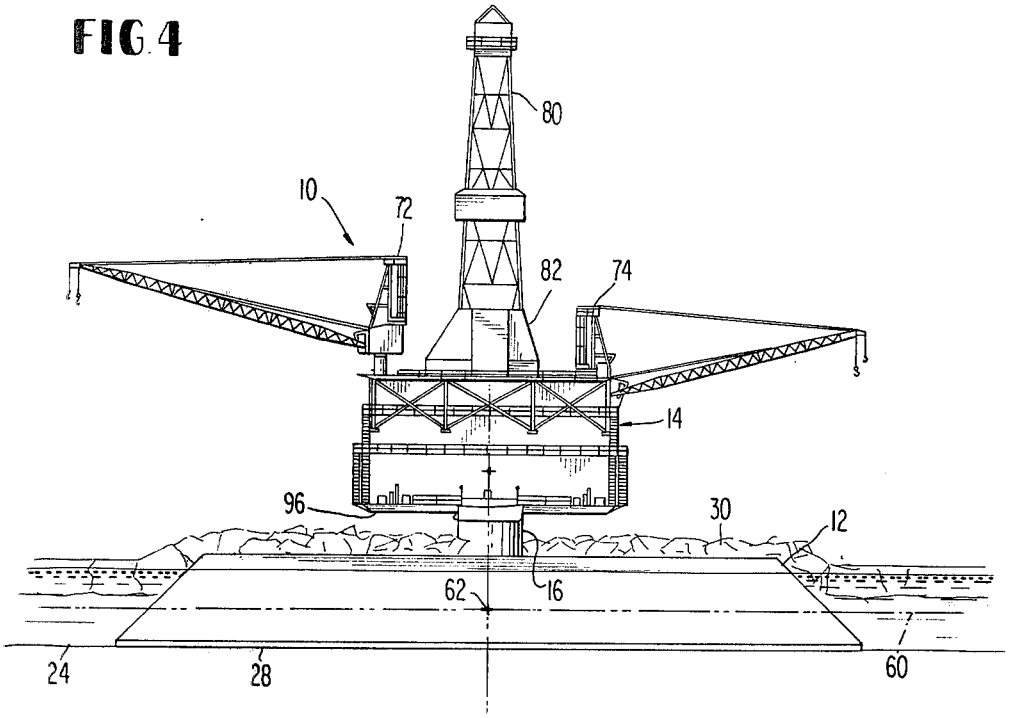
FIG. 4 is a side elevational view of the offshore platform depicted in FIG. 1.

Referring now to the drawings, and particularly to FIG. 1, there will be seen an axonometric representation of an Arctic offshore platform 10 in accordance with a preferred embodiment of the invention. In general terms the subject offshore platform comprises a barge hull 12 and a deck 14 interconnected by first 16 and second 18 generally vertical columns.

The subject invention is preferably intended to operate in an Arctic sea environment where the salt water may freeze into a massive sheet or floe of ice 20. The thickness of the ice sheet 20 may vary with the location of the platform and the time of year but will range from a thin sheet of ice to an intermediate ice depth of a few feet in thickness to in some instances of near shore work ice depths extending essentially down to and juxtaposed to the waterbed 24 of the sea.

In order to minimize lateral ice loading upon the exterior surface of the barge hull 12, the barge is fabricated with an exterior configuration in the general shape of a rectangular frustum having lateral wall surfaces which slope inwardly and upwardly from a base 28 of the barge to an upper barge surface 30. Such a barge configuration has been previously disclosed in the above noted United States Reusswig et al. U.S. Pat. No. 4,080,798.

The exterior surface of skin of the barge 12 is heated by a forced convection technique such as also specifically disclosed in the previously mentioned Reusswig et al. patent. The disclosure of the heating system of this Reusswig et al. patent is hereby incorporated by reference as though set forth at length. Briefly, however, and with reference to FIGS. 2 and 3 the interior portion of at least the side walls 26 are fashioned with forced convection channels 32 which receive heated fluid from a supply conduit 34. The supply conduit joins into a manifold 36 having a plurality of generally upwardly directed nozzles 38 which upwardly discharge into a lower portion of the forced convection channels 32.

Heated fluid exiting via nozzles 38 is pumped upwardly along the surface of the barge skin 26 and heats the surface thereof contiguous to exterior sea ice. The heated fluid then passes through apertures 40 within an upper most portion of each channel 32 and falls into a return chamber 42. Fluid within the return chamber is drawn off by a conduit 44 and the fluid is recycled in a circulatory manner as indicated by directional arrows in FIG. 2 and as more particularly discussed in the Reusswig et al. patent.

As also disclosed in the Reusswig et al. patent, it may be desirable to vary the amount of heating fluid delivered to various elevations of the sloping side surfaces 26 of the barge hull. In this regard, and as specifically depicted in FIG. 3, a plurality of vertically spaced chambers 46, 48, 50, and 52 may be created; each along the lines discussed in connection with FIG. 2. Each one of the spaced chambers is operable to receive independent flows of heated fluid at varying temperatures and/or flow rates. By the provision of these four or more distinct zones the amount of heat energy input at any elevational zone of the exterior surface of the hull may be regulated to insure that exterior ice formations will not freeze to the hull surface while minimizing heat energy utilized in the heating process. In this regard it is only necessary to maintain a thin film of sea water between the next adjacent ambient ice and the sloping lateral walls of the barge hull. As the ice sheet flows toward the stationary hull 12 the ice tends to ride up the sloping surface as depicted in FIG. 1 and the ice fails or crumbles due to bending stresses. This sliding and breakage of the ice will lessen the lateral forces imposed upon the barge hull 12 thereby facilitating the ability of the barge hull to remain on location.

While the Reusswig et al. patent, and the foregoing description, discloses heating the lateral barge surfaces, in some instances, it may be desirable to also heat the barge upper surface 30 to prevent ice from freezing to the upper surface and facilitating the flow of ice up and over the barge hull. This auxilliary upper surface heating may be achieved by forced convection techniques, as previously discussed, or by direct electrical resistance heating as desired.

Figure 5:
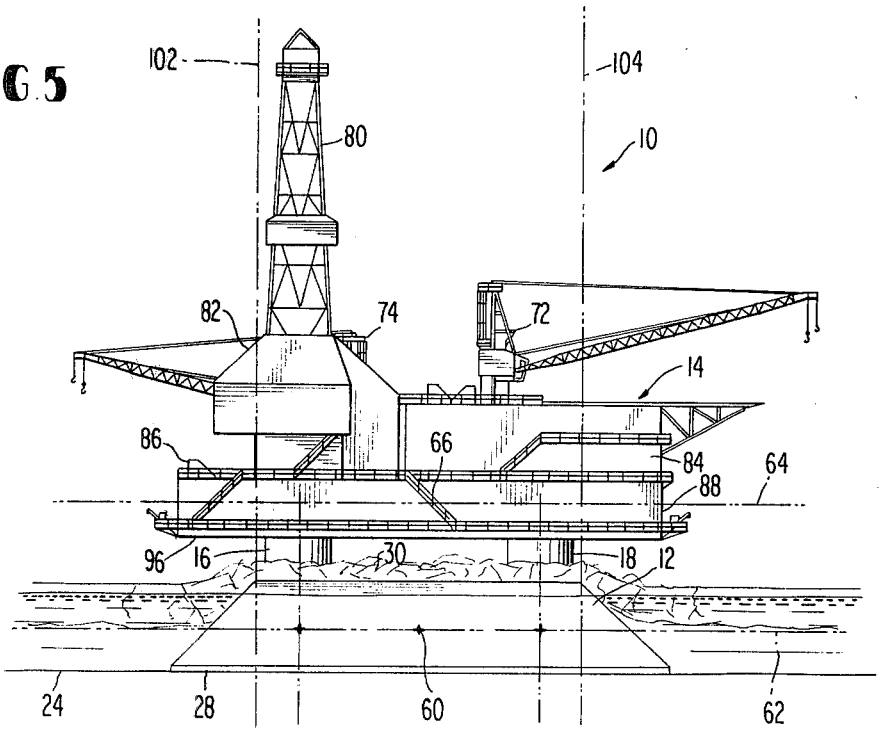
FIG. 5 is an end elevational view of an offshore platform as depicted in FIG. 1.

Referring now to FIGS. 4 and 5 there will be seen side elevational views of the platform in accordance with a preferred embodiment of the invention. More specifically the barge hull 12 has a central longitudinal axis 60 extending from one end of the barge to the other, and a central transverse axis 62 extending from side to side of the barge hull. The height of the barge hull may vary, but for near shore work it is preferred that the height be sufficient so that the base 28 of the barge hull will firmly rest upon the waterbed 24 while the upper surface 30 of the hull extends above the water and/or ice level of the adjacent Arctic waters. In deeper water locations the barge hull will be vertically dimensioned to exceed the depth of statistical maximum depth ice floes.

Internally the barge hull is divided into a plurality of large peripheral ballast compartments and internal bulk storage tanks, not shown. The large bottom surface and ballast volume permits the platform to have a small draft which facilitates placement of the platform in near shore locations. Additionally, the interior portion of the barge is fitted with a plurality of fuel oil and drill water tanks sized to permit extended operations during an ice shut-in season.

Figure 6:
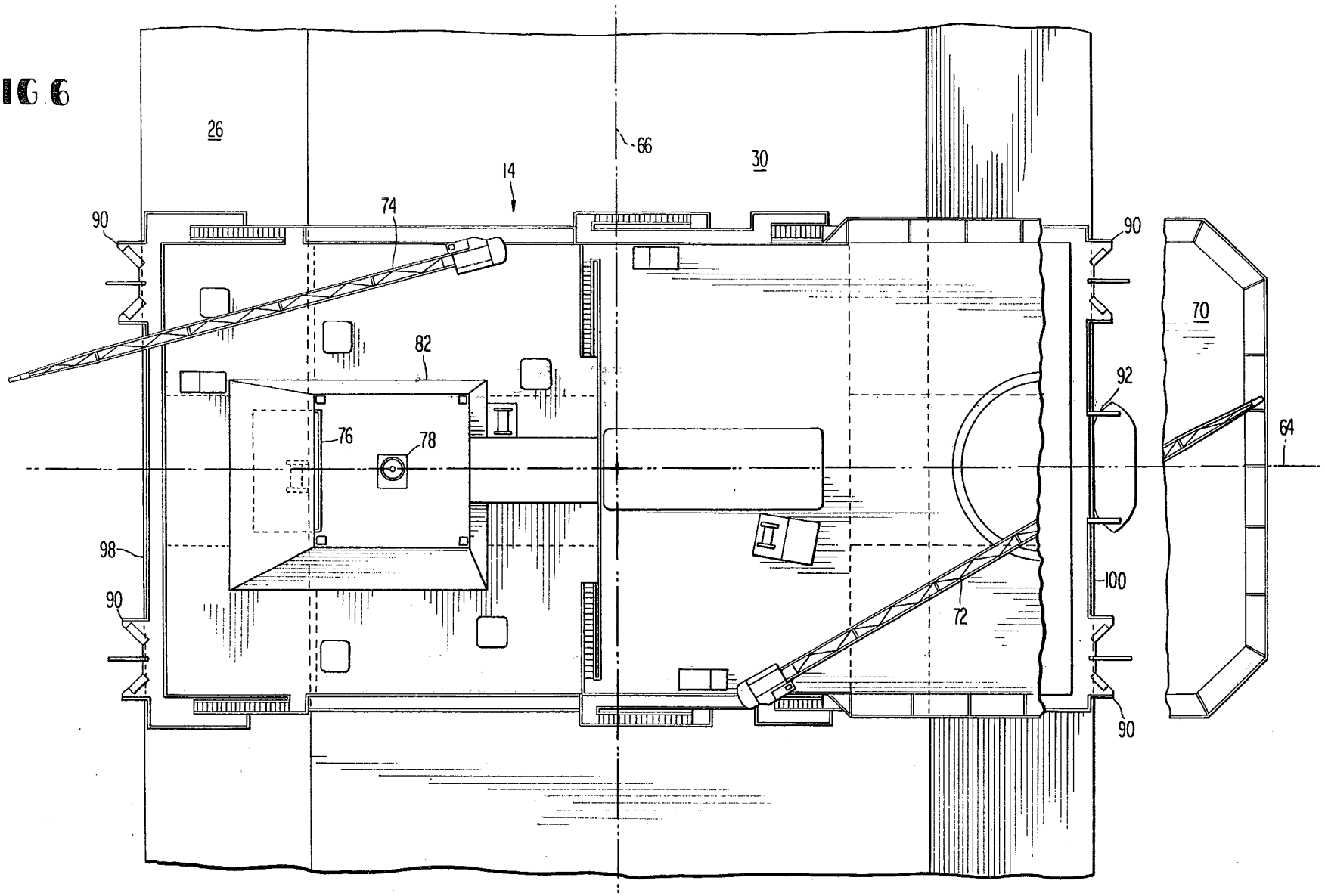
FIG. 6 is a partial plan view of an offshore platform deck in accordance with a preferred embodiment of the invention.

The platform deck 14 is preferably rectangular in a plan view, note FIG. 6, and has a central longitudinal axis 64 extending from one end of the deck to the other and a central transverse axis 66 extending side-to-side thereof. In one operational embodiment an uppermost deck is fitted with the normal complement of equipment suitable to conduct drilling operations and includes a heliport 70, general purpose cranes 72 and 74, a drawworks 76, rotary 78 and a conventional derrick 80. The drill floor is sheltered by a windbreak housing 82 to provide protection during winter work. Crew quarters 84 are positioned beneath the heliport 70 and are incorporated into a main deck 86. A machinery deck 88 underlies the main deck and is provided with electric generators, air compressors, mud processing equipment, cement processing equipment, mechanical and electrical shops, etc. as required to conduct an ongoing drilling operation. In addition to the typical drilling components, the subject platform is constructed with a plurality of variable capacity storage bays operable to store cuttings and the like for a prolonged period of offshore operation. The main deck 86 is further provided with a life raft station 90 at each of its corners and a life boat station 92 between life raft stations as desired.

As previously noted, the deck 14 is supported in an elevated posture with respect to the upper surface 30 of the barge 12 by a first 16 and second 18 supporting column. Each of the columns 16 and 18 are preferably tubular cylinders having a circular cross-section. The support column 16 is positioned beneath the derrick 80 and functions as a drilling column for offshore operations while the column 18 provides crew access via an elevator to the barge hull and various deck floors.

The support columns 16 and 18 are vertically dimensioned so as to support a lowermost surface 96 of the deck at an elevation above the upper surface 30 of the barge such that statistical arctic storm waves and/or ice floes will be guided across the upper surface of the barge without impinging upon the lowermost portion of the deck, note particularly FIGS. 4 and 5.

In addition to being elevated with respect to the uppermost surface of the barge hull, the deck 14 is uniquely oriented such that the longitudinal axis of the deck 64 is parallel with the transverse axis 62 of the barge hull and perpendicular to the longitudinal axis 60 thereof. Moreover, the longitudinal dimension of the deck 14 is sufficient such that opposite end most portions 98 and 100 of the deck extend beyond imaginary planes 102 and 104, note FIG. 5, projecting upwardly from the longitudinal edges of the uppermost surface 30 of the barge. In this orientation, the life raft stations 90 as well as the lifeboat station 92 project beyond the lateral edge surfaces of the barge hull. Accordingly, emergency escape from the deck may be effected from either the drilling or quarters end of the platform by lowering life rafts or boats onto an underlying sea.

In addition to providing emergency escape routes for the working deck, the subject cross-orientation of the hull and deck permits the long axis of the underlying barge hull to be perpendicular to the transverse axis of the working deck. Accordingly, the aerodynamic beam forces encountered by the working deck are reacted by the major dimension of the underlying supporting barge.

In operation the subject platform is towed to a preselected offshore Arctic location during an open water season. The barge hull and deck have been optimized to provide minimum draft such that the barge may be positioned in shallow water near shore locations of the Arctic such as exist in the Beaufort Sea wherein operations may be conducted in water depths of 7 to 30 feet.

On location the barge takes on ballast and descends to the seabed. A cassion is set, surface casing is lowered through the support column 16 and drilling operations are commenced. The subject platform is designed to remain on station during the ice season and provide a year round drilling capability.

SUMMARY OF MAJOR ADVANTAGES OF THE INVENTION

After reading and understanding the foregoing description of the invention, in conjunction with the drawings, it will be appreciated that several distinct advantages of the subject platform are obtained. Without attempting to set forth all of the desirable features of the instant offshore platform, as specifically and inherently disclosed hereinabove, at least one of the illustrative advantages of the subject invention comprises the unique combination of an offshore Arctic platform wherein a heated barge hull is provided in combination with a posted deck whereby ice floes and storm waves are directed up and over the barge hull without impacting directly upon the working deck.

In a preferred embodiment the deck support consists of two circular columns. This structure minimizes resistance of the supporting structure to ice floes passing over the hull while providing drilling access to the seabed and crew transportation access to the various decks and hulls.

The unique orientation of the deck with respect to the barge hull minimizes the effect of aerodynamic forces or any unexpected hydrodynamic or ice forces upon the working deck by providing the maximum reaction moment arm of the barge hull perpendicular with respect to the beam of the deck. Synergistically such a deck posture provides an avenue for emergency escape from one or both ends of the deck by lifeboats or rafts which may descend directly onto the sea or ice surfaces from the platform deck.

The rectangular frustum hull configuration which supports a dual posted deck permits the platform to achieve a minimum draft for near shore operations. Moreover, the dual posted arrangement enable the deck superstructure to be minimized while a maximum soil bearing surface is provided by the barge bottom surface.

Still further the hull and deck shape in combination with the supporting circular posts minimizes the overall structural weight of the platform and facilitates fabrication time and expense.

The variable storage capacity of the deck permits the unit to operate on station in the Arctic while retaining cuttings for subsequent removal.

In describing the invention, reference has been made to a preferred embodiment and illustrative advantages of the invention. Those skilled in the art, however, and familiar with the instant disclosure of the subject invention, may recognize additions, deletions, modifications, substitutions, and/or other changes which will fall within the purview of the subject invention and claims.

We claim:

1. An offshore platform operable for use along near shore arctic locations where prolonged ice conditions may be encountered, said platform comprising:

a lower barge hull operable to rest directly upon and be supported by the seabed at a near shore arctic location, said barge hull having an exterior configuration in the general shape of a rectangular frustum with upwardly and inwardly sloping lateral side walls extending from the seabed to a position above a water and/or ice surface of the contiguous sea, said barge hull having a central longitudinal axis extending end-to-end thereof and a central transverse axis extending side-to-side thereof;

means for heating at least said lateral side walls of said barge hull for facilitating movement of sea ice up the inclined barge side walls to fail the sea ice in bending as the ice advances towards said barge hull;

generally rectangular deck means positioned above said lower barge hull for supporting offshore operations, said deck means having a central longitudinal axis extending end-to-end thereof and a central transverse axis extending side-to-side thereof;

means for supporting said deck means in an elevated posture with respect to an upper surface of said barge hull, said means for supporting comprising, first column means extending between the upper surface of said barge hull and a lower surface of said deck means for maintaining the lower surface of said deck above the upper surface of said hull and out of contact with sea ice passing over said barge hull, and second column means extending between an upper surface of said barge hull and a lower surface of said deck means for maintaining the lower surface of said deck above the upper surface of said barge hull and out of contact with sea ice passing over said barge hull; wherein said deck means being positioned above said barge hull in a position such that the longitudinal axis of said deck means extends at right angles to the longitudinal axis of said barge hull and at least one end of said deck means extends beyond an imaginary vertical plane projecting upwardly from at least one longitudinal edge of the upper surface of said barge hull.

2. An offshore platform as defined in claim 1 wherein:

said means for supporting said deck means consists of said first and second column means.

3. An offshore platform as defined in claim 1 wherein said first and second column means each comprise:

generally tubular columnar structures having a circular cross-section.

4. An offshore platform as defined in claim 1 wherein:

said deck means is dimensioned such that said deck means extends beyond imaginary vertical planes projecting upwardly from opposing longitudinal edges of the upper surface of said barge hull.

5. An offshore platform as defined in claim 1 wherein:

central longitudinal axes of said first and second column means intersect both the central longitudinal axis of said deck means and the central transverse axis of said barge hull.

6. An offshore platform as defined in claim 1 wherein:

said first and second column means each comprise generally tubular columnar structures having a circular cross-section, and said means for supporting said deck means consists of said first and second column means.

7. An offshore platform as defined in claim 6 wherein:

central longitudinal axes of each of said first and second column means intersect both the central longitudinal axis of said deck means and the central transverse axis of said barge hull and said deck means is dimensioned such that said deck means extends beyond imaginary vertical planes projecting upwardly from opposing longitudinal edges of the upper surface of said barge hull.

8. An offshore platform operable for use along near shore arctic locations where prolonged ice conditions may be encountered, said platform comprising:

a lower barge hull operable to floatingly support the offshore platform during transportation to a desired working site and to take on ballast and engage the seabed at the desired working site, said barge hull having an exterior configuration in the general shape of a rectangular frustum with upwardly and inwardly sloping lateral side walls extending from the seabed to a position above a water and/or ice surface of the contiguous sea, said barge hull having a central longitudinal axis and a central transverse axis;

means for heating at least the lateral side walls of said barge hull for facilitating movement of sea ice up the inclined barge side walls to fail the sea ice in bending as the ice advances toward said barge hull;

deck means positioned above said lower barge hull for supporting offshore operations;

means for supporting said deck means in an elevated posture with respect to an upper surface of said barge hull, said means for supporting comprising, first column means extending between the upper surface of said barge hull and a lower surface of said deck means for maintaining the lower surface of said deck means above the upper surface of said barge hull and out of contact with sea ice passing over said barge hull, and second column means extending between the upper surface of said barge hull and a lower surface of said deck means for maintaining the lower surface of said deck means above the upper surface of said barge hull and out of contact with sea ice passing over said barge hull; wherein said first and second column means each having central longitudinal axes and being positioned between said deck means and said barge hull such that said column axes both intersect the central transverse axis of said barge hull and at least a portion of said deck means extends beyond an imaginary vertical plane projecting upwardly from at least one longitudinal edge of the upper surface of said barge hull.

9. An offshore platform as defined in claim 8 wherein:

said deck means being dimensioned such that said deck extends beyond imaginary vertical planes projecting upwardly from both of the longitudinal edges of the upper surface of said hull.

10. An offshore platform as defined in claim 9 wherein:

said means for supporting said deck means consists of first and second column means.

11. An offshore platform operable for use in arctic locations where prolonged ice conditions may be encountered, said platform comprising:

a lower barge hull having an exterior configuration in the general shape of a rectangular frustum with upwardly and inwardly sloping lateral side walls extending from a position beneath a statistical lowermost portion of contiguous sea ice to a position above the surface of the sea ice, said barge hull having a central longitudinal axis and a central transverse axis and being operable to be generally fixedly stationed with respect to a desired seabed site;

means for heating at least the lateral side walls of said barge hull for facilitating movement of sea ice up the inclined barge side walls to fail the sea ice in bending as the ice advances toward said barge hull;

generally rectangular deck means positioned above said lower barge hull for supporting offshore operations, said deck means having a central longitudinal axis and a central transverse axis;

means for supporting said deck means in an elevated posture with respect to an upper surface of said barge hull, said means for supporting comprising, first column means extending between an upper surface of said barge hull and a lower surface of said deck means for maintaining the lower surface of said deck above the upper surface of said hull and out of contact with sea ice passing over said barge hull, and second column means extending between an upper surface of said barge hull and a lower surface of said deck means for maintaining the lower surface of said deck above the upper surface of said barge hull and out of contact with sea ice passing over said barge hull; wherein said deck means being positioned above said barge hull in a posture such that the longitudinal axis of said deck means extends at right angles to the longitudinal axis of said hull and at least one end of the said deck means extends beyond an imaginary vertical plane projecting upwardly from at least one longitudinal edge of the upper surface of said barge hull.

12. An offshore platform as defined in claim 11 wherein:

said means for supporting said deck consists of said first and second column means and said first and second column means being circular in cross-section.

13. An offshore platform as defined in claim 11 wherein:

a central longitudinal axis of each of said first and second column means intersect both the central longitudinal axis of said deck means and the central transverse axis of said hull; and said deck means being dimensioned such that said deck extends beyond imaginary vertical planes projecting upwardly from both the longitudinal edges of the upper surface of said hull.

14. An offshore platform as defined in claim 13 wherein:

said means for supporting said deck consists of said first and second column means and said first and second column means being circular in cross-section.

* * * * *